US011035576B2

(12) United States Patent
Johnson et al.

(10) Patent No.: US 11,035,576 B2
(45) Date of Patent: Jun. 15, 2021

(54) COOKING APPLIANCE WITH SIDE OPENING RETRACTABLE DOOR

(71) Applicants: BSH Home Appliances Corporation, Irvine, CA (US); BSH Hausgeräte GmbH, Munich (DE)

(72) Inventors: Sean Johnson, New Bern, NC (US); Kenneth Jones, Washington, NC (US); Robert Parchman, Newport, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 202 days.

(21) Appl. No.: 16/451,253

(22) Filed: Jun. 25, 2019

(65) Prior Publication Data

US 2020/0408421 A1 Dec. 31, 2020

(51) Int. Cl.
*F24C 15/02* (2006.01)
*E05D 15/58* (2006.01)

(52) U.S. Cl.
CPC ..... *F24C 15/026* (2013.01); *F24C 15/028* (2013.01); *E05D 2015/586* (2013.01)

(58) Field of Classification Search
CPC ..... E05D 15/58; E05D 2015/586
See application file for complete search history.

(56) References Cited

U.S. PATENT DOCUMENTS

| | | | | |
|---|---|---|---|---|
| 2,252,139 | A | 8/1941 | Schlacter | |
| 2,925,081 | A * | 2/1960 | Shooter | F24C 15/026 126/190 |
| 3,127,889 | A * | 4/1964 | Mills | E05D 15/582 126/194 |
| 5,657,743 | A * | 8/1997 | Schwarzbacker | F24C 15/026 126/194 |
| 8,047,198 | B2 * | 11/2011 | Meyer | F24C 15/023 126/190 |
| 8,500,224 | B2 | 8/2013 | Moeller | |
| 9,254,919 | B2 * | 2/2016 | Schootstra | B64D 11/04 |
| 2006/0289530 | A1 * | 12/2006 | Cordae | F24C 15/026 219/756 |
| 2018/0087779 | A1 * | 3/2018 | Maldonado | F24C 15/026 |

FOREIGN PATENT DOCUMENTS

GB 2549189 A 10/2017

OTHER PUBLICATIONS

Slide & Hide Ovens; Neff; Online: http://www.neff-home.com; Publication Unknown. Accessed Dec. 3, 2018.

* cited by examiner

*Primary Examiner* — David J Laux
(74) *Attorney, Agent, or Firm* — Michael E. Tschpp; Andre Pallapies; Brandon G. Braun

(57) ABSTRACT

An appliance may include an appliance door configured to selectively open and close a cavity of the appliance. The door may be side-opening and retractable into a door storage space situated laterally adjacent to the appliance cavity. The door may be arrested in alignment with a track in the door storage space by an abutment portion of the door, and transitioned into the door storage space on rollers engaged with a track.

14 Claims, 6 Drawing Sheets

COOKING APPLIANCE WITH SIDE OPENING RETRACTABLE DOOR

FIELD

This disclosure relates to cooking appliances having side-opening doors.

INTRODUCTION

Cooking appliances have developed since antiquity to provide a better experience for their users. These developments have occurred in nearly every aspect of the appliance, from the cooking cavity itself to the heating source used. Modern cooking appliances have developed several key features that provide a safer environment and a more efficient use of space.

SUMMARY

The present disclosure provides systems, apparatuses, and methods relating to cooking appliances having side-opening doors.

In some embodiments, an appliance may include: an appliance body having a cavity formed therein; a side-opening appliance door configured to selectively cover the cavity by pivoting between an open position and a closed position on a vertically-oriented hinge; a door storage space having an open mouth disposed at a lateral side of the appliance body; a roller assembly coupled to the hinge of the appliance door and having one or more rollers engaged with a track disposed in the door storage space; wherein the appliance door includes an abutment portion configured to pivot with the door and to arrest opening of the door by physically contacting the hinge when the door is aligned with the track of the door storage space, such that the appliance door is transitionable into and out of the door storage space along a path defined by the track.

In some embodiments, an appliance may include: an appliance body; a side-opening appliance door coupled to the appliance body and rotatable on a vertically-oriented hinge; a door storage space having an open mouth disposed on a lateral side of the appliance body; and a roller assembly coupled to the hinge of the appliance door and having one or more rollers engaged with a track disposed in the door storage space; wherein the appliance door is transitionable between a closed configuration, in which a rear face of the appliance door is disposed against a front face of the appliance body, and a fully open configuration, in which the appliance door is oriented in alignment with the track, and further transitionable between the fully open configuration and a stowed configuration, in which the door is inserted into the door storage space along the track; and wherein the appliance door is arrested in the fully open configuration by an abutment portion of the door coming into contact with the vertical hinge.

In some embodiments, a method for operating a door of a cooking appliance may include: opening a side-opening door of a cooking appliance, wherein the door has a vertical hinge, until the door is substantially orthogonal to a front face of the cooking appliance and is arrested by a portion of the door coming into contact with the hinge; and applying a first force aligned with a plane of the door to cause the door to travel in a first direction along a path defined by a track guiding a roller assembly coupled to the door hinge, such that the door is inserted into a door storage space on a lateral side of the cooking appliance.

Features, functions, and advantages may be achieved independently in various embodiments of the present disclosure, or may be combined in yet other embodiments, further details of which can be seen with reference to the following description and drawings.

DETAILED DESCRIPTION

Figure 1:
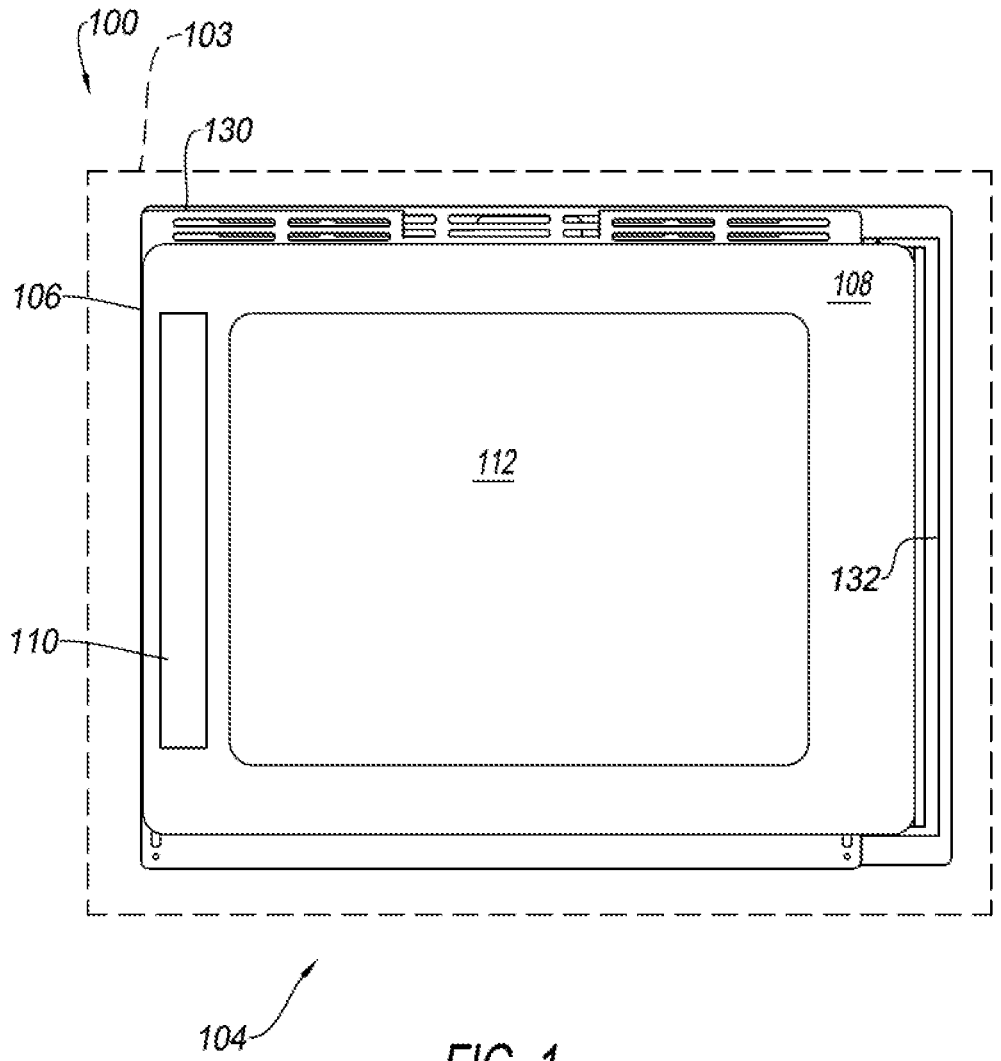
FIG. 1 is a front elevation view of an illustrative cooking appliance having a single door in accordance with aspects of the present disclosure.

Various aspects and examples of a cooking appliance having a side-opening, retractable door are described below and illustrated in the associated drawings. Unless otherwise specified, a cooking appliance in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections A through C, each of which is labeled accordingly.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

Directional terms such as "up," "down," "vertical," "horizontal," and the like should be understood in the context of the particular object in question. For example, an object may be oriented around defined X, Y, and Z axes. In those examples, the X-Y plane will define horizontal, with up being defined as the positive Z direction and down being defined as the negative Z direction.

Overview

In general, a cooking appliance, e.g., an oven, in accordance with the present teachings may include an outer housing and an inner cavity, wherein a door storage space between the inner cavity and the outer housing is configured to receive a door of the appliance when in a retracted configuration. The door is disposed on a front face of the appliance, and is configured to close the inner cavity. The door is transitionable between a first position, external to the cavity and the housing, and a second position, where the door is disposed inside the door storage space, utilizing a hinge-roller assembly and a track. The track is mounted in the door storage space, such that the track is disposed external to the insulation of the inner cavity but inside the outer housing of the appliance. In some examples, the door storage space may be disposed in a wall of a building (e.g., when the oven is a wall oven). The track may be mounted directly to the outer housing.

During normal operation, the door is extended (i.e., unretracted) and pivotable about an axis of rotation defined by a vertical hinge, such that a user may open and close the door as desired. In a storage configuration (i.e., when the door is retracted), the door storage space houses the door inconspicuously and provides the user with unimpeded access to the inner cavity and the space around the cavity opening. The door of an appliance can become an easy point of injury when heated, and unimpeded access to and around the inner cavity provides a safer alternative to leaving the door open and extending into the human-occupied space.

The full operating range of the door is provided by way of the hinge-roller assembly and the track. The hinge-roller assembly includes a body or carriage having rollers that ride in channels of the track. The hinge is coupled to an outermost side of the hinge-roller assembly, such that as the assembly is retracted into the appliance, the hinge is the last piece of the assembly to enter the door storage space (before the door).

The hinge-roller assembly is seated in the tracks such that the entire assembly can retract into the space between the inner cavity and the outer housing. The door is attached to the hinge-roller assembly via the hinge. This allows the door to rotate fully open, and when fully opened, to translate along a linear path defined by the tracks. The retracting motion of the door may be manually effected, or may be automated, semi-automated, or assisted with a biasing mechanism (e.g. springs, pneumatics, etc.). The biasing mechanism may be contained within the track, coupled to the door, coupled to the hinge-roller assembly, or disposed in any suitable place inside or outside the appliance.

Transitioning of the door between positions may be locked or selectively impeded with a locking mechanism, such that the door is restricted to one (or more) positions. The locking mechanism may be engaged through the use of friction locks, user-engaged pins, or any other suitable mechanism. The locking mechanism may be contained within the track, coupled to the housing of the appliance, coupled to the door, or disposed in any suitable place inside or outside the appliance.

Appliances described herein may include a damping system configured to control rotational motion of the door e.g., to prevent damage or injury. This damping system may include a shock absorber or spring configured to dampen motion of the door as it closes or opens, so the door is prevented from slamming and/or placing excess stress on the hinge mechanism. The damping system may be incorporated into the hinge, coupled to the door, or disposed in any other suitable place inside or outside the appliance. In some examples, a second damping system may be provided to control the translational motion of the door as it slides into and/or out of the door storage space. This second damping system may be incorporated in the track, coupled to the door, or disposed in any other suitable place inside or outside the appliance.

Examples, Components, and Alternatives

The following sections describe selected aspects of a side opening, retracting appliance door as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Cooking Appliance with a Side Opening, Retracting Door

As shown in FIGS. 1-6, this section relates to a cooking appliance having a side opening door configured to retract into the appliance.

FIG. 1 is a front elevation view of an illustrative one-door, side opening appliance 100. A heat insulated inner cavity 102 (see FIG. 2) may be configured to be mounted inside an outer housing 103, wherein inner cavity 102 has a front face 104 with a front opening which allows a user access to inner cavity 102. Front face 104 may include a frame 130 having a plurality of vents disposed thereon and an opening or slot 132 formed in a lateral portion of front face 104 (see FIG. 2). Frame 130 may be configured to adjoin outer housing 103 to form a front face of appliance 100.

Appliance 100 may have a heat insulated door 106 disposed across the front opening of inner cavity 102 which closes the inner cavity. Door 106 comprises a body 108, a handle 110, and a viewing window 112. Inner cavity 102 may have support grooves 114 (see FIG. 2) on the inner side-walls, e.g., to support cooking racks (not shown).

Figure 2:
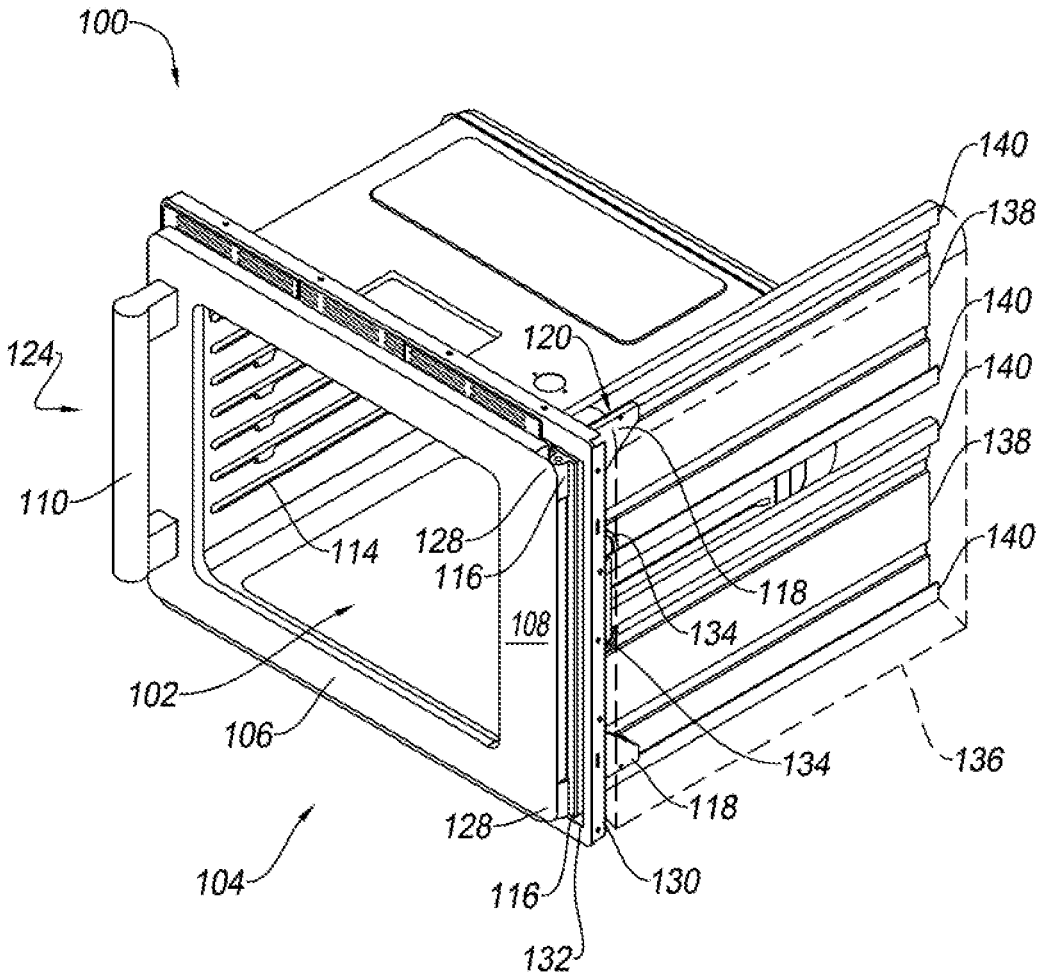
FIG. 2 is a front oblique isometric view of the appliance of FIG. 1 with the door in a closed position.

FIG. 2 is a front oblique isometric view of appliance 100. Door 106 may be coupled to and pivotable about a hinge 116. Hinge 116 defines an operable range of rotation of door 106 about a rotational axis, and may be coupled to a hinge-roller assembly 120. Hinge-roller assembly 120 may further comprise a body 118 and a plurality of rollers 134. Body 118 and rollers 134 may be referred to as a roller carriage.

Body 118 of hinge-roller assembly 120 may include a plate, a bracket, multiple plates, or any other suitable support structure on which hinge 116 and rollers 134 may be mounted. Door 106 may be transitionable between a plurality of unretracted positions about the rotational axis, including a closed position 124 and an opened position 126 (see FIG. 3). Hinge-roller assembly 120 may be disposed in slot 132 when door 106 is in positions 124 and 126 (or between the two). Hinge 116 may include a spring or other biasing mechanism configured to bias door 106 against unintentionally opening. Alternatively or additionally, hinge 116 may bias door 106 against unintentionally closing.

Door body 108 may include one or more abutment portions 128 adjacent hinge 116 and configured to abut one or more portions of hinge 116 when door 106 is in the fully opened position, thereby arresting further movement. Abutment portions 128 are configured to keep door 106 from rotating beyond a position that is substantially aligned with the path formed by tracks 138. Abutment portions 128 may include any suitable structure configured to arrest motion of door 106 by contacting hinge 116 and/or front face 104. In this example, abutment portions 128 are formed by recesses or cutouts in door body 108, such that a rear side of the front face or panel of door body 108 is exposed. The recesses or cutouts in body 108 are configured to receive the knuckles of hinge 116, such that the abutment portions lie substantially flat along (or adjacent to) a tangent line of each hinge knuckle. In the present embodiment, two abutment portions 128 are formed on the corners of door 106, adjacent hinge 116. Alternatively, or additionally, more or fewer abutment portions 128 may be formed at any point along the hinge-side edge of door 106. In some examples, the abutment portion includes the entire hinge-side edge of door 106, i.e., formed as a single stopping surface.

As door 106 is transitioned from closed position 124 to open position 126, abutment portions 128 follow the rotational axis of hinge 116 and forms a tangent plane with respect to the contour of the hinge knuckle. As door 106 reaches the open position 126, the abutment portions contact the hinge knuckles and mechanically halt the transition of door 106, preventing continued rotation of door 106. When in opened position 126, abutment portions 128 restrict the door from opening beyond a position substantially perpendicular to front face 104.

Slot 132 is an opening to (or mouth of) a door storage space 136 disposed between inner cavity 102 and outer housing 103. Two or more tracks 138 (also referred to as track portions) may be disposed inside door storage space 136. A plurality of rails 140 are disposed on each track 138. Tracks 138 may be mounted to inner cavity 102 and/or outer housing 103. In some embodiments a single track may be used. Hinge-roller assembly 120 may be seated in tracks 138, such that rollers 134 are seated in rails 140; wherein the rollers 134 and rails 140 facilitate the translational motion of door 106 along a linear axis and define the operable range of translation of door 106.

Figure 3:
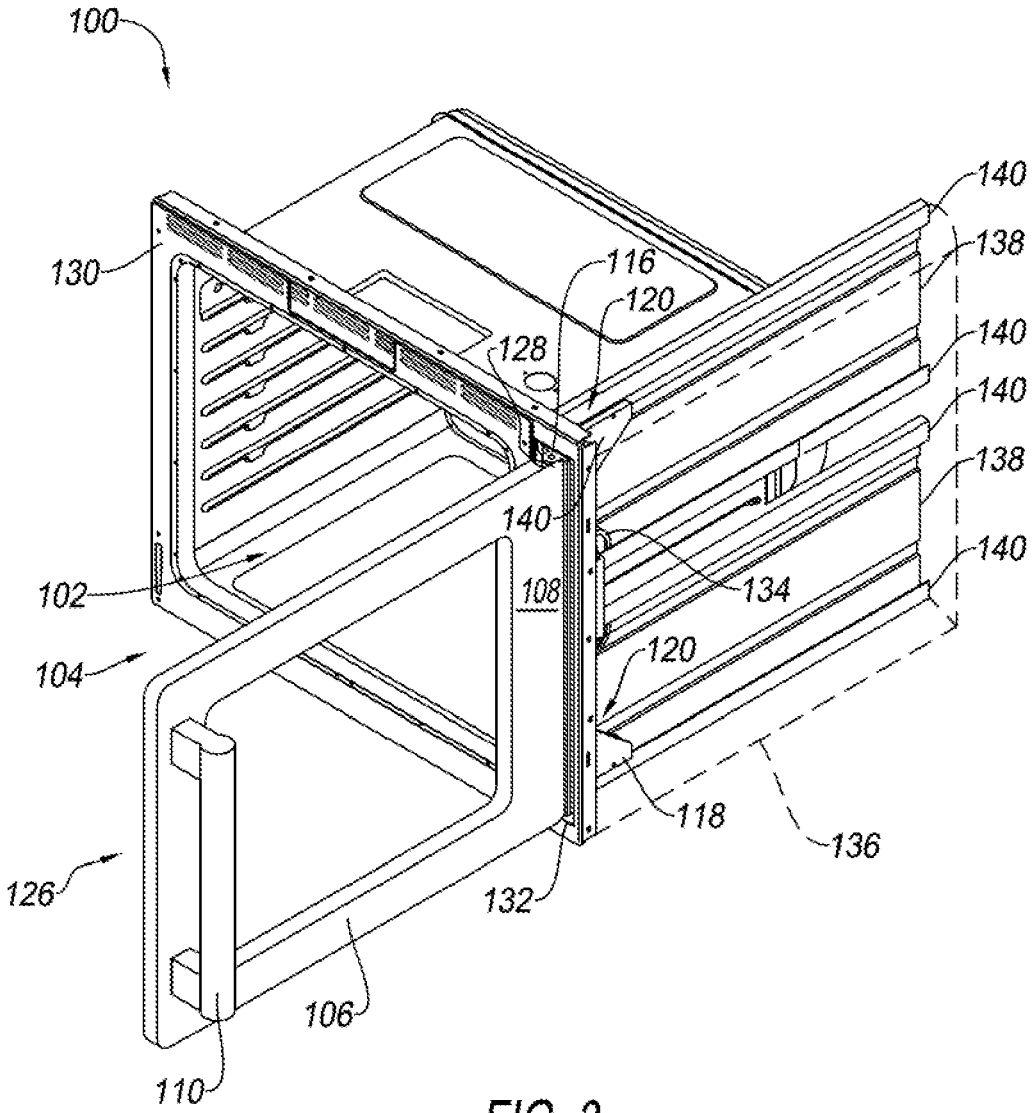
FIG. 3 is an isometric view of the appliance of FIG. 1 with the door in an opened position.

FIG. 3 is an isometric view of door 106 in opened position 126. In opened position 126, door 106, hinge-roller assembly 120, and tracks 138 align in a generally coplanar fashion, such that door 106 is retractable into door storage space 136 along a path formed by the channels of the track portions. In some embodiments, hinge 116 may be a friction hinge, spring hinge, or other type of hinge configured such that door 106 is held in opened position 126 to allow retraction while inhibiting unwanted motion along the rotational axis. In opened position 126, the front opening is unobstructed, providing access to inner cavity 102.

Figure 4:
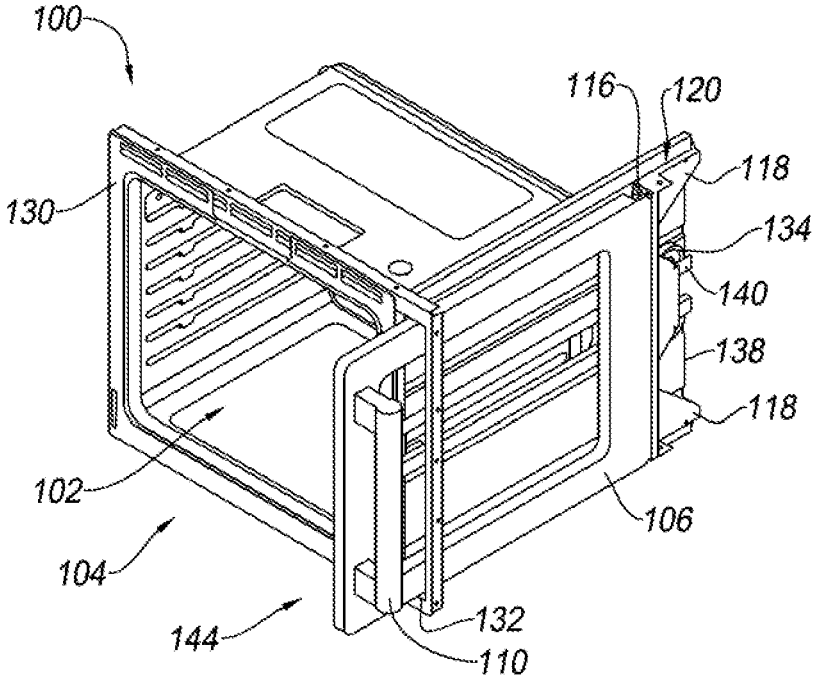
FIG. 4 is an isometric view of the appliance of FIG. 1 with the door in a retracted position.

FIG. 4 is an isometric view of door 106 in a retracted position 144. In retracted position 144, the living space in front of appliance 100 is unobstructed and the user has a lower risk of contacting door 106. Hinge-roller assembly 120 may retract fully into door storage space 136, allowing door 106 to enter door storage space 136. When in retracted position 144, movement of door 106 about the hinge may be inhibited.

Door storage space 136 may be formed such that door 106 only partially enters door storage space 136 when in retracted position 144, while handle 110 remains outside of door storage space 136. This allows the user easy access to handle 110 to pull door 106 out of retracted position 144, e.g., when ready to transition door 106 back to closed position 124. In some embodiments, there may be a temporary locking mechanism that locks door 106 in retracted position 144 such that unwanted motion of door 106 along the linear axis may be discouraged. This locking mechanism may include, for example, indentations in rails 140 that hold rollers 134 in place while door 106 is in retracted position 144.

Figure 5:
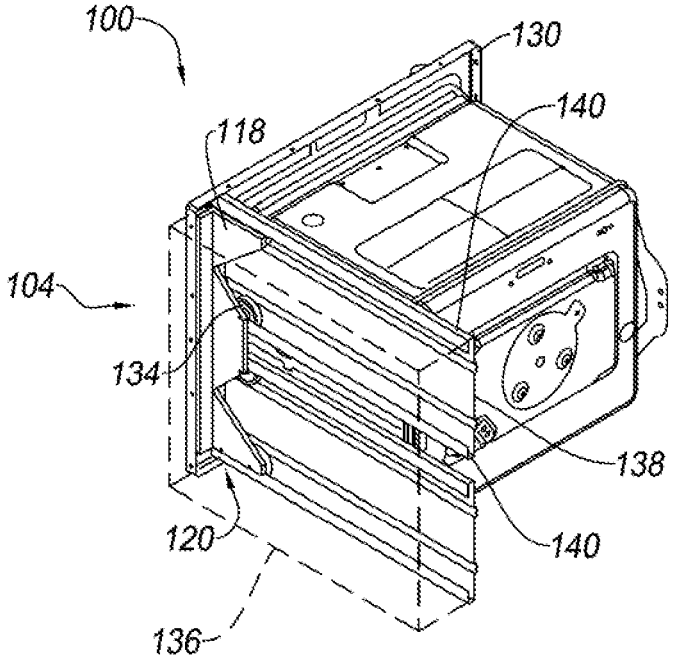
FIG. 5 is a rear oblique isometric view of the appliance of FIG. 1 showing rollers seated in tracks.

FIG. 5 is a rear oblique isometric view of appliance 100 further showing rollers 134 seated in rails 140. Rollers 134 and rails 140 may be configured such that the weight of door 106 is supported across multiple rails.

Figure 6:
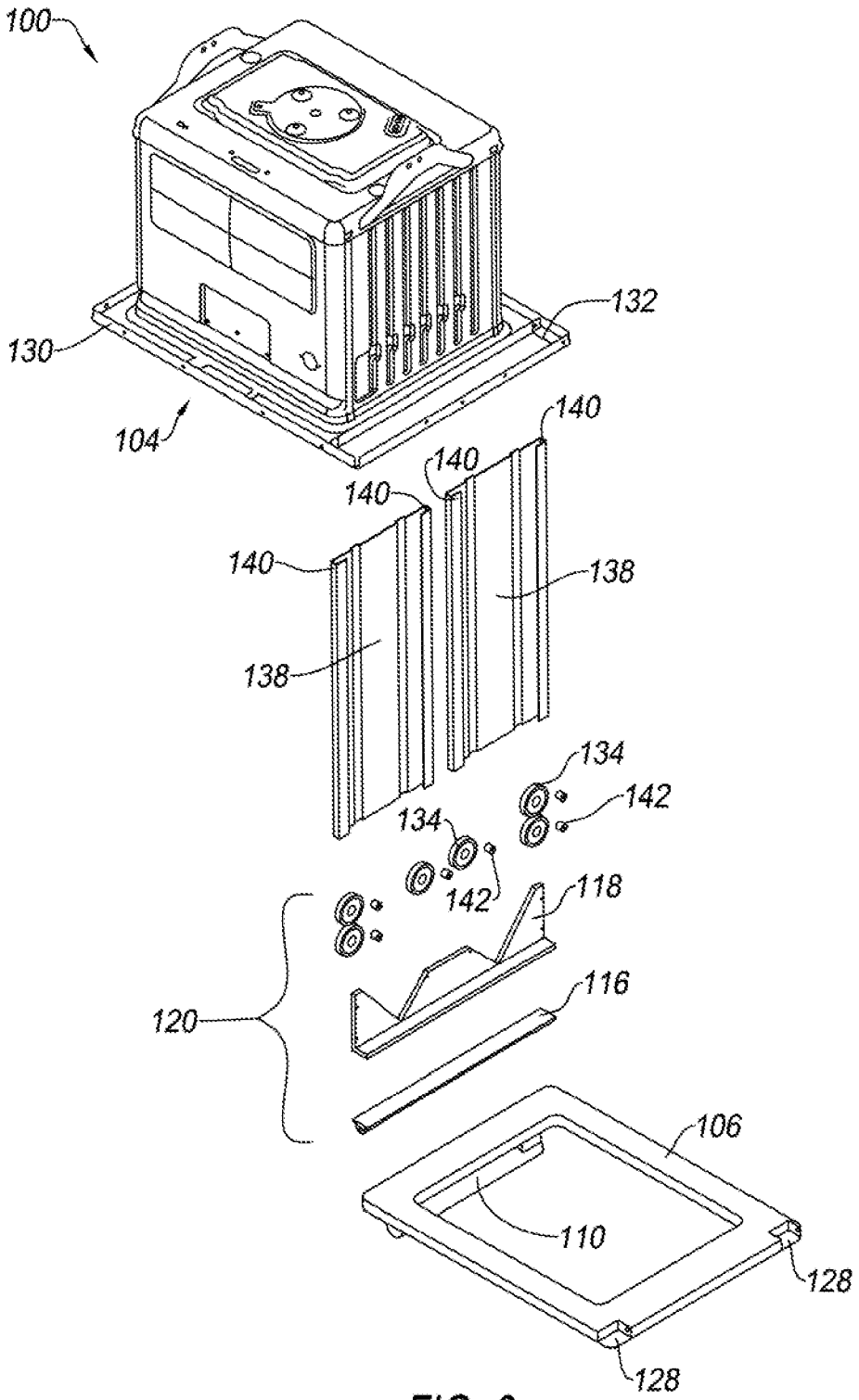
FIG. 6 is an exploded view of the appliance of FIG. 1 depicted from a rear oblique perspective.

FIG. 6 is an exploded view of hinge-roller assembly 120, door 106, tracks 138, and inner cavity 102 depicted from a rear oblique perspective. Each member of the plurality of rollers 134 may have an associated axle bearing 142 disposed therein to facilitate low-friction rotation of rollers 134.

B. Illustrative Method

Figure 7:
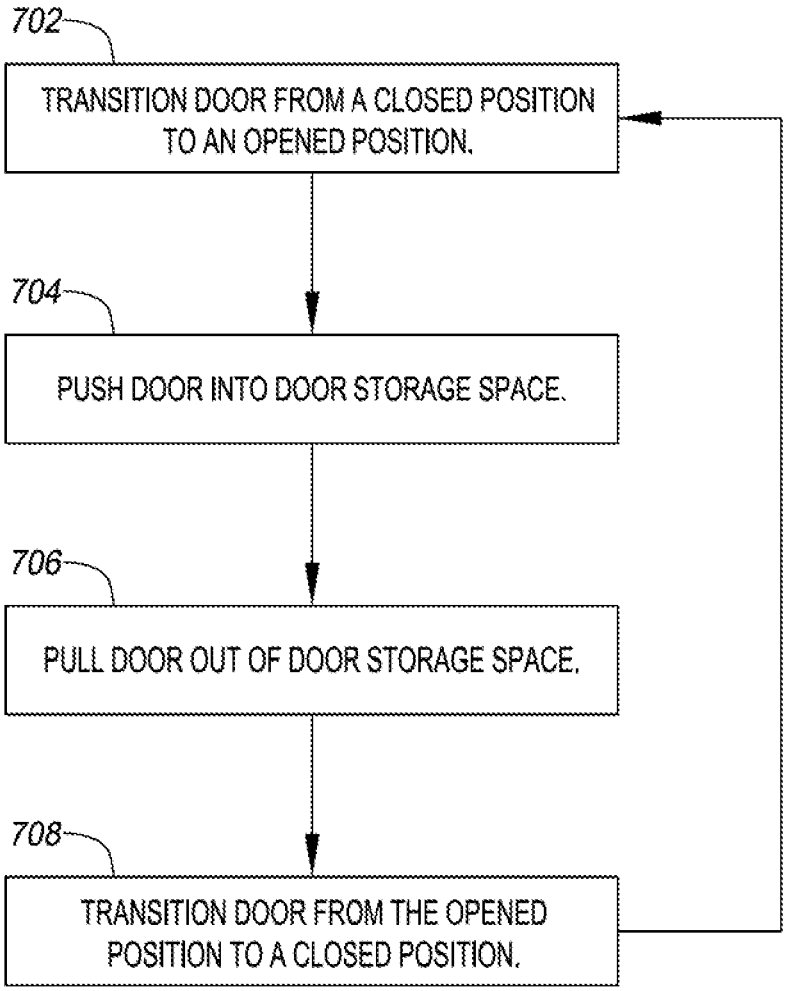
FIG. 7 is a flowchart depicting steps in an illustrative method for operating an appliance door.

This section describes steps of an illustrative method 700 for retracting an appliance door into a door storage space; see FIG. 7. Aspects of the cooking appliance with a side-opening, retracting door described in the previous section may be utilized in the method steps described below. Where appropriate, reference may be made to components and systems that may be used in carrying out each step. These references are for illustration, and are not intended to limit the possible ways of carrying out any particular step of the method.

FIG. 7 is a flowchart illustrating steps performed in an illustrative method, and may not recite the complete process or all steps of the method. Although various steps of method 700 are described below and depicted in FIG. 7, the steps need not necessarily all be performed, and in some cases may be performed simultaneously or in a different order than the order shown.

At step 702, the door of a cooking appliance (e.g., an oven) is transitioned from a closed position to an opened position. This transition includes rotating the door about a substantially vertical hinge. The door and hinge are external to the appliance such that the radial path traced by the door as it transitions from the closed position to the opened position is entirely external to the appliance and defines a plane parallel to the bottom surface of the appliance. When in the opened position, the door aligns with a linear path defined by a track, wherein the track is disposed within a door storage space internal to the appliance. The inner cavity of the appliance is accessible to a user. The door may be stopped from opening beyond a position perpendicular to a face of the appliance, e.g., by one or more abutment portions configured to mechanically halt action of the door in the opening direction.

At step 704, the door is pushed into the door storage space, guided by the track disposed within the space. The door may only partially enter the door storage space, such that a handle on the door remains outside the door storage space to be available to the user.

At step 706, the door is pulled out of the door storage space, guided by the track disposed within the space. The door is pulled out of the appliance until the entire door and hinge are positioned external to the door storage space and the door and hinge are aligned with the path defined by the track.

At step 708, the door is transitioned from the opened position to the closed position by pivoting about the hinge. The rotational motion of the door is similar to step 702, though applied in reverse. When in the closed position, the inner cavity of the appliance is closed. The steps of method 700 may then be repeated if desired.

C. Illustrative Combinations and Additional Examples

This section describes additional aspects and features of a side-opening appliance with a retracting door, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A1. A cooking appliance comprising:

an outer housing having a front face with an opening;

an inner cavity contained within the housing;

a door storage space separating the inner cavity from the outer housing, wherein the opening of the inner cavity and the opening of the outer housing align such that the inner cavity is accessible through the opening of the outer housing, a hinge-roller assembly which includes a body having rollers and a hinge which defines an axis of rotation attached thereon, a track having rails configured to mate with the rollers disposed in the door storage space defining a linear axis;

wherein the hinge-roller assembly mounts to the track and follows the linear axis, and a door configured to transition from a closed position to an open position;

wherein the door is attached to the hinge-roller assembly via the hinge such that the door, from the opened position, can be retracted into the door storage space along the linear axis defined by the track.

A2. The appliance of paragraph A1, wherein the door is side-opening.

A3. The appliance of paragraph A1, wherein the appliance is wall-mounted with the outer housing mounted inside a wall cavity.

A4. The appliance of paragraph A1, wherein the hinge acts as a biasing mechanism to hold the door in the closed position until sufficient force in applied to overcome the bias.

A5. The appliance of paragraph A1, wherein there is a locking mechanism that locks the door in the door storage space.

A6. The appliance of paragraph A3, wherein the locking mechanism is a potential well embodied as indentations in the rails that seat the rollers.

B0. A method of retracting an appliance door into a door storage space contained within a cooking appliance, the method comprising: transitioning the door from a closed position to an open position along a radial path defined by a hinge; and pushing the door along a linear path into the door storage space.

B2. The method of paragraph B0, wherein the door is side-opening.

B3. The method of paragraph B0, wherein the appliance is wall-mounted.

C0. An appliance, comprising:

an appliance body having a cavity formed therein;

a side-opening appliance door configured to selectively cover the cavity by pivoting between an open position and a closed position on a vertically-oriented hinge;

a door storage space having an open mouth disposed at a lateral side of the appliance body;

a roller assembly coupled to the hinge of the appliance door and having one or more rollers engaged with a track disposed in the door storage space;

wherein the appliance door includes an abutment portion configured to pivot with the door and to arrest opening of the door by physically contacting the hinge when the door is aligned with the track of the door storage cavity, such that the appliance door is transitionable into and out of the door storage space along a path defined by the track.

C1. The appliance of C0, wherein the appliance comprises a wall-mounted oven.

C2. The appliance of C0, wherein the abutment portion comprises a front plate of the appliance door.

C3. The appliance of C2, wherein the abutment portion comprises a flat surface formed by a cutout portion of the appliance door exposing the front plate of the appliance door to the hinge.

C4. The appliance of C0, wherein the track comprises two parallel track portions, each track portion having an upper and a lower channel.

C5. The appliance of C4, wherein the plurality of rollers are guided by the upper and lower channels of each track portion.

C6. The appliance of C0, wherein the hinge comprises a pair of hinge knuckles disposed in corresponding cutouts of the appliance door.

C7. The appliance of C0, wherein the door is orthogonal to a front face of the appliance when aligned with the track of the door storage space.

C8. The appliance of C0, wherein the track has a C-shaped cross section.

C9. The appliance of C0, wherein a front plate of the appliance door extends over and hides the vertical hinge when the appliance door is in a closed position.

D0. A method for operating a door of a cooking appliance, the method comprising:

opening a side-opening door of a cooking appliance, wherein the door has a vertical hinge, until the door is substantially orthogonal to a front face of the cooking appliance and is arrested by a portion of the door coming into contact with the hinge; and applying a first force aligned with a plane of the door to cause the door to travel in a first direction along a path defined by a track guiding a roller assembly coupled to the door hinge, such that the door is inserted into a door storage space on a lateral side of the cooking appliance.

D1. The method of D0, wherein the portion of the door that comes into contact with the hinge comprises a front plate of the door.

D2. The method of D1, wherein the front plate of the door is exposed to the hinge by a cutout in a body of the door.

D3. The method of D0, further comprising applying a second force aligned with the plane of the door to cause the door to travel in a second direction along the path defined by the track guiding the roller assembly coupled to the door hinge, such that the door is removed from the door storage space.

D4. The method of D0, wherein a handle of the door remains outside the door storage space when the door is inserted into the door storage space.

E0. An appliance comprising:

an appliance body;

a side-opening appliance door coupled to the appliance body and rotatable on a vertically-oriented hinge;

a door storage space having an open mouth disposed on a lateral side of the appliance body;

a roller assembly coupled to the hinge of the appliance door and having one or more rollers engaged with a track disposed in the door storage space;

wherein the appliance door is transitionable between a closed configuration, in which a rear face of the appliance door is disposed against a front face of the appliance body, and a fully open configuration, in which the appliance door is oriented in alignment with the track, and further transitionable between the fully open configuration and a stowed configuration, in which the door is inserted into the door storage space along the track;

wherein the appliance door is arrested in the fully open configuration by an abutment portion of the door coming into contact with the vertical hinge.

E1. The appliance of E0, wherein the door is oriented orthogonal to the front face of the appliance body when in the fully open configuration.

E2. The appliance of E0, wherein the track includes a track portion having a C-shaped cross section.

E3. The appliance of E0, wherein the appliance comprises a wall-mounted oven.

E4. The appliance of E0, wherein the abutment portion comprises a front plate of the appliance door.

E5. The appliance of E4, wherein the abutment portion comprises a flat surface formed by a cutout portion of the appliance door exposing the front plate of the appliance door to the hinge.

E6. The appliance of E0, wherein the track comprises two parallel track portions, each track portion having an upper and a lower channel.

E7. The appliance of E6, wherein the plurality of rollers are guided by the upper and lower channels of each track portion.

E8. The appliance of E0, wherein the hinge comprises a pair of hinge knuckles disposed in corresponding cutouts of the appliance door.

E9. The appliance of E0, wherein a front plate of the appliance door extends over and hides the vertical hinge when the appliance door is in a closed position.

Advantages, Features, and Benefits

The different embodiments and examples of the described herein provide several advantages over known solutions for a side-opening appliance door that is configured to retract into an appliance. For example, illustrative embodiments and examples described herein allow the inner cavity of an appliance to be completely unobstructed for a user to access.

Additionally, and among other benefits, illustrative embodiments and examples described herein allow a wall-mounted appliance to be installed in a smaller area considering the door, when retracted, does not obstruct the region directly in front of the appliance.

Additionally, and among other benefits, illustrative embodiments and examples described herein allow the user reduced risk of burns from accidental contact with the door considering the door is housed in the door storage space while the user accesses the inner cavity of the appliance.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. An appliance, comprising:

an appliance body having a cavity formed therein;

a side-opening appliance door configured to selectively cover the cavity by pivoting between an open position and a closed position on a vertically-oriented hinge;

a door storage space having an open mouth disposed at a lateral side of the appliance body; and a roller assembly coupled to the hinge of the appliance door and having one or more rollers engaged with a track disposed in the door storage space;

wherein the appliance door includes an abutment portion configured to pivot with the door and to arrest opening of the door by physically contacting the hinge when the door is aligned with the track of the door storage space, such that the appliance door is transitionable into and out of the door storage space along a path defined by the track wherein the abutment portion comprises a front plate of the appliance door and a flat surface formed by a cutout portion of the appliance door exposing the front plate of the appliance door to the hinge.

2. The appliance of claim 1, wherein the appliance comprises a wall-mounted oven.

3. The appliance of claim 1, wherein the track comprises two parallel track portions, each track portion having an upper and a lower channel.

4. The appliance of claim 3, wherein the one or more rollers are guided by the upper and lower channel of each track portion.

5. The appliance of claim 1, wherein the hinge comprises a pair of hinge knuckles disposed in corresponding cutouts of the appliance door.

6. The appliance of claim 1, wherein the door is orthogonal to a front face of the appliance when aligned with the track of the door storage space.

7. An appliance comprising:

an appliance body;

a side-opening appliance door coupled to the appliance body and rotatable on a vertically-oriented hinge;

a door storage space having an open mouth disposed on a lateral side of the appliance body; and a roller assembly coupled to the hinge of the appliance door and having one or more rollers engaged with a track disposed in the door storage space;

wherein the appliance door is transitionable between a closed configuration, in which a rear face of the appliance door is disposed against a front face of the appliance body, and a fully open configuration, in which the appliance door is oriented in alignment with the track, and further transitionable between the fully open configuration and a stowed configuration, in which the door is inserted into the door storage space along the track; and wherein the appliance door is arrested in the fully open configuration by an abutment portion of the door coming into contact with the vertical hinge wherein the abutment portion comprises a front plate of the appliance door and a flat surface formed by a cutout portion of the appliance door exposing the front plate of the appliance door to the hinge.

8. The appliance of claim 7, wherein the door is oriented orthogonal to the front face of the appliance body when in the fully open configuration.

9. The appliance of claim 7, wherein the track includes a track portion having a C-shaped cross section.

10. The appliance of claim 7, wherein the hinge comprises a pair of hinge knuckles disposed in corresponding cutouts of the appliance door.

11. The appliance of claim 7, wherein a front plate of the appliance door extends over and hides the vertical hinge when the appliance door is in a closed position.

12. A method for operating a door of a cooking appliance, the method comprising:

opening a side-opening door of a cooking appliance, wherein the door has a vertical hinge, until the door is substantially orthogonal to a front face of the cooking appliance and is arrested by a portion of the door coming into contact with the hinge; and applying a first force aligned with a plane of the door to cause the door to travel in a first direction along a path defined by a track guiding a roller assembly coupled to the door hinge, such that the door is inserted into a door storage space on a lateral side of the cooking appliance wherein the portion of the door that comes into contact with the hinge comprises a front plate of the door, which is exposed to the hinge by a cutout in a body of the door.

13. The method of claim 12, further comprising applying a second force aligned with the plane of the door to cause the door to travel in a second direction along the path defined by the track guiding the roller assembly coupled to the door hinge, such that the door is removed from the door storage space.

14. The method of claim 12, wherein a handle of the door remains outside the door storage space when the door is inserted into the door storage space.

* * * * *